US006295795B1

(12) United States Patent
Ehrmann

(10) Patent No.: US 6,295,795 B1
(45) Date of Patent: Oct. 2, 2001

(54) EQUINE LEAD LINE ASSEMBLY

(76) Inventor: Douglas G. Ehrmann, 75 Beverly Hill Rd., Clifton, NJ (US) 07012

( * ) Notice: Subject to any disclaimer, the term of this patent is extended or adjusted under 35 U.S.C. 154(b) by 0 days.

(21) Appl. No.: 09/572,326

(22) Filed: May 18, 2000

(51) Int. Cl.[7] ..... B68B 1/00
(52) U.S. Cl. ..... 54/34; 54/24
(58) Field of Search ..... 54/24, 34, 85; 119/792, 793, 795, 835

(56) References Cited

U.S. PATENT DOCUMENTS 297,963 * 5/1884 Barnard ..... 54/24
432,414 * 7/1890 Knight ..... 54/24
815,164 * 3/1906 Hayner ..... 54/24
4,459,795 * 7/1984 Le Tixerant ..... 54/24 X

* cited by examiner

*Primary Examiner*—Robert P. Swiatek
(74) *Attorney, Agent, or Firm*—James F. Cottone

(57) ABSTRACT

An equine lead line assembly is specially configured to provide significantly improved handling of a horse in a much less stressful manner for both horse and handler. Advantageously, a lead line assembly formed as a deformable closed loop portion carrying a pair of swivel snaps, and a connected hand lead line portion, functions to impart a gentle tightening and downward pressure on the horse's muzzle. This control aid applies symmetrical forces to both sides of a conventional halter via the deformable loop portion in response to a single downward force applied via the hand lead line portion.

10 Claims, 2 Drawing Sheets

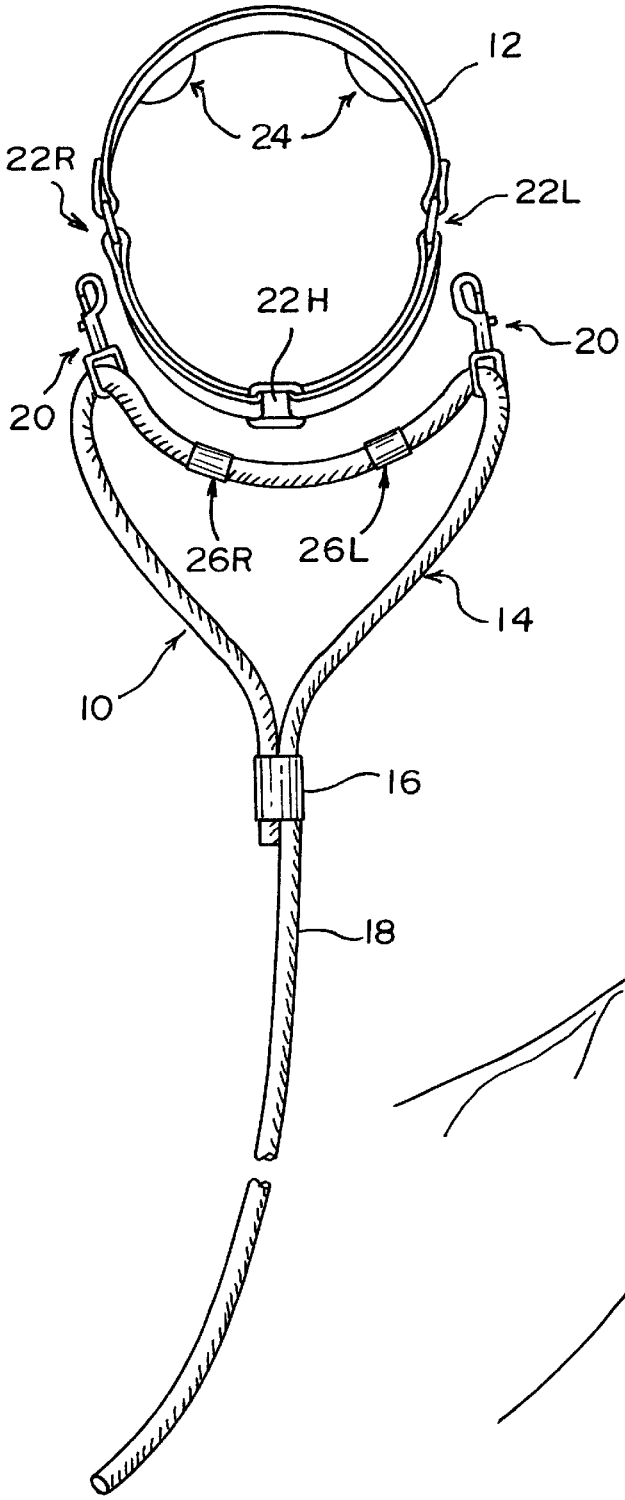
FIG. 1
FIG. 2
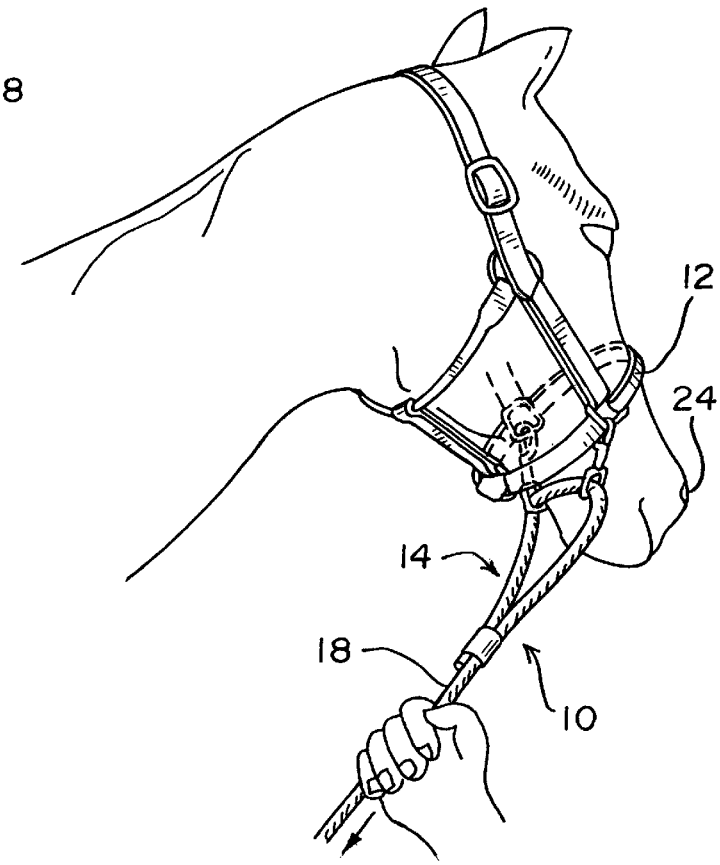

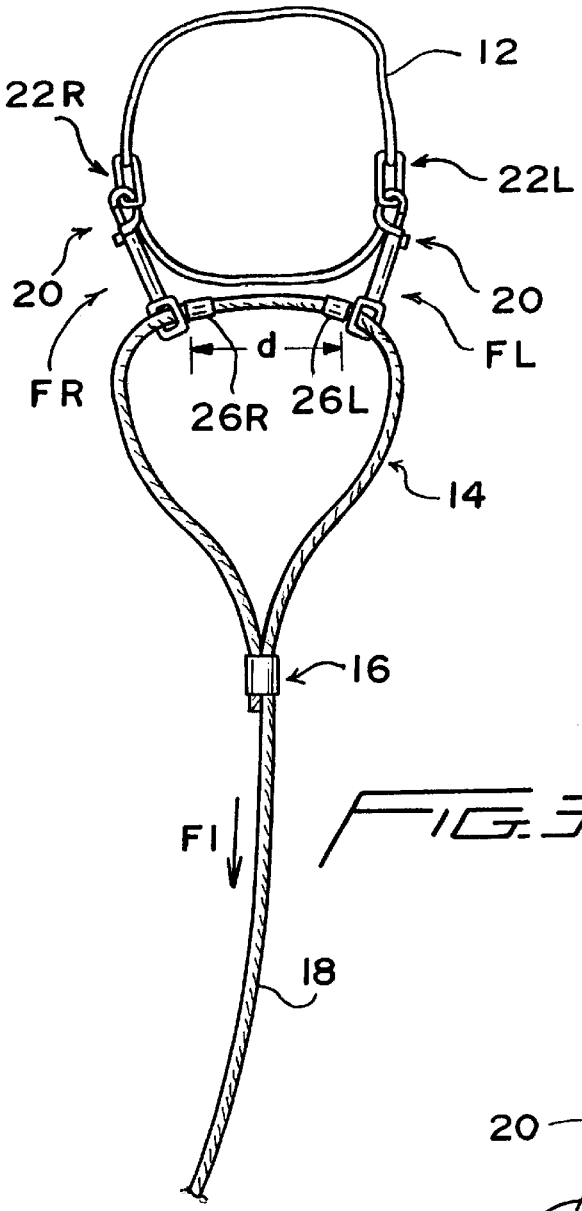
FIG. 3
FIG. 5
PRIOR ART
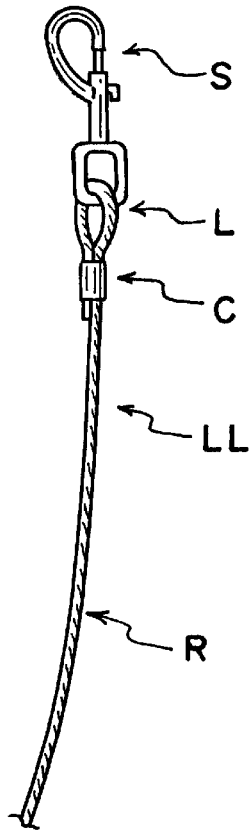
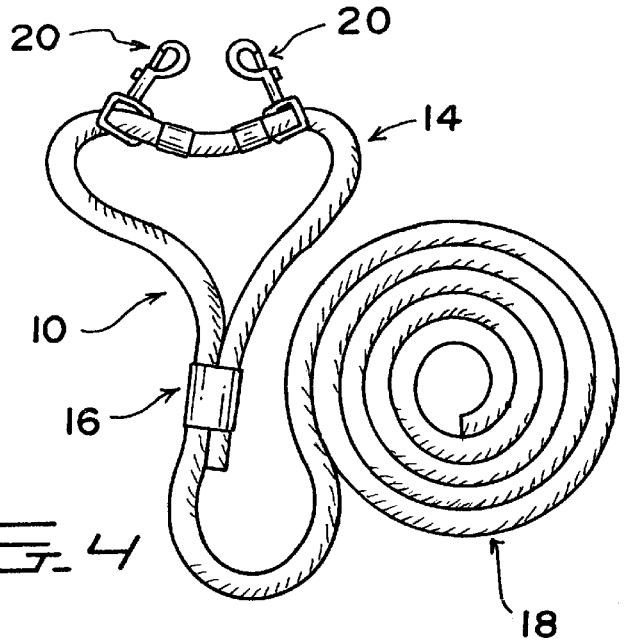
FIG. 4

EQUINE LEAD LINE ASSEMBLY

TECHNICAL FIELD

The present invention relates generally to equine lead lines, and more particularly to a unique lead line assembly specifically configured to greatly improve the handling of horses using an elegantly simple structural assembly for applying smoothly controllable pressures to a horse's muzzle.

BACKGROUND

Methods and apparatus for handling horses have been the subject of much invention and development for centuries. The basic multi-strapped halter and attached lead lines are known in many different forms, each form providing a response to the particular equine-related needs to be met as well as to the availability and cost of materials from which the articles may be fabricated. Halters vary from simple rough and ready designs to the intricate and ornate, and lead lines—as compared to reins and harnesses—have tended to be mostly utilitarian in design and function. Historically, a lead line has been viewed as merely a length of rope affixed to a halter or to the animal's neck to provide some degree of control for a horse handler.

Descriptions of typical prior art approaches to lead line structures, and their interactions with and interconnections to horse halters may be found in a number of U.S. and foreign patent documents.

U.S. Pat. No. 5,317,989 to Swanson et al. discloses an adjustable animal collar formed from flexible webbing material which includes an adjustable loop to implement a choke collar, particularly directed for use with dogs.

European patent document 0 018 915 to Le Tixerant provides a good example of a Y-shaped lead line adapted to attach to both sides of a horse halter. The function of this lead line, which includes a pair of swivel snaps, is stated as allowing the horse to be led from either the left or right side.

Two U.S. design patents provide showings of halter ropes and lead lines whose structures are worthy of scrutiny. Design Patent 391,694 to Eichhorn discloses a self-shortening halter rope having a pair of swivel snaps which appear to be attachable to a halter, but it is unclear how the shortening action is accomplished. And, Design Patent 156,177 to Kinskie shows a lead line (in phantom) threaded through a pair of halter side rings, but the distance between the rings appears to be fixed.

Two early U.S. patents (issued in the 1880's) are of interest for their showings of hitching ropes having generally Y-shaped lead lines which attach to each of a pair of side rings that are integral parts of horse halters. These are U.S. Pat. No. 0,398,965 to Hunt wherein snaps G and H attach to rings I and J; and U.S. Pat. No. 0,379,056 to Dowlin wherein a hitching rope p is looped through left and right rings d.

While each of these prior art approaches function more or less adequately, they have not to date provided the ease of control afforded by the present lead line assembly—which greatly improves the ability to handle the horse being led.

OBJECTS OF THE INVENTION

It is therefore a primary object of the present invention to provide an improved equine lead line assembly which makes handling a horse easier and less stressful for both horse and handler.

A further object of the present invention is to provide a lead line assembly fabricated from well known and conventional materials in the form of a closed loop of fixed circumferential length which deforms in use to impart desired control pressures to a horse fitted with a suitable halter A still further object of the present invention is to provide a method of leading a horse which produces reduced stress on horse and handler by converting a handler's slight downward force on the hand lead line into a pair of symmetrical forces which function to urge a portion of an associated halter gently down on the horse's muzzle.

In a preferred embodiment, an elegantly simple closed loop carrying a pair of swivel snaps at one end is attached at its other end to a length of hand lead line. When the pair of snaps on the thus-configured lead line assembly are attached to left and right side rings on a conventional halter including a muzzle or nose strap, an unexpected high degree of handling control is realized. The lead line assembly functions to convert a handler's slight downward force on the hand lead line to symmetrical deformation of the closed loop portion, causing the pair of snaps to move closer together leading to a gentle downward pressure on the horse's muzzle.

BRIEF DESCRIPTION OF THE DRAWINGS

Additional objects and advantages of the invention will become apparent to those skilled in the art as the description proceeds with reference to the accompanying drawings, wherein:

FIG. 1 is a pictorial representation of an equine lead line assembly according to the present invention, shown in proximity to a horse halter to which it is attached;

FIG. 2 is an overall right side view of the equine lead line assembly shown in use on a horse being handled;

FIG.3 is a highly schematic frontal view of a lead line assembly depicting its gentle deforming of an attached halter;

FIG. 4 shows a complete lead line assembly arranged ready for use, including a typical length of hand lead line coiled for convenience; and FIG. 5 shows a conventional prior art lead line in widespread use in the equine community.

BEST MODE FOR CARRYING OUT THE INVENTION

Referring now to FIG. 1 there is shown a pictorial representation of the equine lead line assembly according to the present invention. The lead line assembly shown generally at 10 is depicted in proximity to a conventional horse halter 12 to which it is attached in use. The lead line assembly 10 is made up of flexible rope or similar material, and includes a closed loop 14 formed into one end by the use of a deformable clamp 16, and a convenient length of hand lead line 18. A pair of swivel snaps or snap hooks 20 are threadedly positioned within the loop 14 prior to its being formed. The halter 12, which does not form an intrinsic part of the present invention, includes the usual pair of side rings, and possibly an under ring. A left side ring 22L, right side ring 22R and under ring 22U are labeled with respect to their positioning on a halter with a horse's nostrils 24 shown to aid in viewer orientation. In use, the lead line assembly 10 is affixed to the halter 12 via the snaps 20 (as best seen in the overall view of FIG. 2), so as to provide the benefits of easier and less stressful handling.

Referring to FIG. 3 there is shown a highly schematic frontal view of the lead line assembly 10 slightly tensioned to apply its optimized horse controlling pressures. In response to a downward force F1 applied by the handler via the hand lead line 18, the loop 14 assumes the approximate shape shown, which causes the distance d between the swivel snaps 20 to shorten (as compared to the slackened loop shape seen in FIG. 1). As the length of line d between the snaps becomes shorter due to the symmetrical application of a force pair FL and FR, the halter is pulled down which applies a gentle tightening of the halter on the horse's muzzle. Remarkably, the effect of this slight increase in the amount of control force exerted is significantly greater than would be expected for the slight amount of force applied via the hand lead line 18. And, more remarkably, the lead line assembly 10 makes handling a horse easier and much less stressful on both horse and handler.

The relation between the downward force F1 and the distance d between the snaps 20 is determined largely by the various force components involved—especially the restraining and frictional forces. With brief reference again to FIG. 1, additional structures incorporated into the loop 14 further affect this F1/d relationship. A pair of short soft plastic tubing sections 26L and 26R are fitted over the flexible line making up the loop 14 prior to its being closed. The tubing sections are identical, may be about 2–3 inches in length, and are sized to provide a slight frictionally snug fit over the flexible rope used for the loop 14. Functionally, the tubing sections 26L/26R serve to slightly impede the movement of the snaps 20 over their outer diameters due to their softness. Thus, the inclusion of this pair of tubing sections, whose length and number may be varied to accommodate various horse sizes and lead line uses, prevents the distance d from becoming overly short responsive to a given range of magnitudes of the handler's applied force F1.

Resuming with the discussion of FIG. 3, the seemingly slight tightening action on the horse's muzzle via the halter 12 results in a surprisingly high degree of animal control requiring very little force from the handler. And, the less force and pressures required, the better the results for all involved.

FIG. 4 shows a complete lead line assembly 10 arranged ready for use. The length of the hand lead line 18 may be set as desired with typical lengths contemplated as falling in the range of 8–12 foot (about 2½ to 3½ meters).

Brief reference to FIG. 5 shows a conventional prior art lead line LL consisting of a snap hook S though which is threaded a loop L formed by a clamp C. In use, the snap hook S is attached to any conveniently positioned ring or other portion of a halter. Leading of the horse is then accomplished via the usual forces applied by movements of the handler's arm. Very little has changed in this basic approach, and every experienced horse handler has encountered situations where this basic lead line arrangement called for stressful actions to achieve the desired degree of animal control.

Alternate embodiments of the lead line assembly 10 may form the closed loop 14 by means other than the use of a compressible clamp. Weaving, heat welding, riveting, simple knotting and related techniques and processes may be employed as appropriate for various flexible line materials used.

Although the invention has been described in terms of a preferred embodiment, the invention should not be deemed limited thereto since other embodiments and modifications—such as substitution of materials for the flexible line or the tubing elements, and alternate means of forming the closed loop beyond the basic clamp arrangement—will readily occur to one skilled in the art. It is therefore to be understood that the appended claims are intended to cover all such modifications as fall within the true spirit and scope of the invention.

What is claimed is:

1. An equine lead line assembly for providing reduced stress handling of a horse, comprising:

a) a closed loop of flexible line formed at a first end of a lead line assembly;

b) a length of flexible hand lead line affixed to said closed loop and constituting a second end of said lead line assembly;

c) a pair of snap hooks threadedly carried by said closed loop;

d) whereby upon attaching said snap hooks to left and right sides of a halter disposed about a horse's head, and applying a downward force to said closed loop via said hand lead line, the length of the flexible line between said snap hooks and hence the distance between said snap hooks decreases in correspondence to the amount of hand lead line applied force.

2. The lead line assembly of claim 1 wherein said closed loop is formed from a fixed length of flexible line such that as the loop deforms under said applied downward force the circumferential extent of said loop remains constant.

3. The lead line assembly of claim 2 further comprising at least one flexible tubing member disposed surrounding said flexible line, the length of said at least one tubing member being less than one tenth the length of said fixed length of flexible line and the diameter of said at least one tubing member being slightly greater than the diameter of said flexible line, whereby said tubing member engages said flexible line in a loose friction fit.

4. The lead line assembly of claim 3 wherein said at least one tubing member is positioned along the loop at a location between said pair of snap hooks and the tubing material exhibits a particular range of friction at its outer surface such that the distance between said snap hooks decreases a first amount corresponding to the hand lead line applied downward force in the absence of engagement with said at least one tubing member and decreases a second lesser amount when said snap hooks frictionally engage said at least one tubing member.

5. The lead line assembly of claim 4 wherein said lead line assembly is made up from a unitary length of flexible line having said closed loop formed by clamping together a first end of said unitary length at a predetermined fixed length along said unitary length and said hand lead line extending therefrom to a second end of said unitary length.

6. A method of providing reduced stress handling of a horse fitted out with a halter having a pair of rings positioned at left and right sides of a halter nose strap, said method comprising the steps of:

a) providing a closed loop of flexible line formed at a first end of a lead line assembly;

b) providing a length of flexible hand lead line affixed to said closed loop and constituting a second end of said lead line assembly;

c) providing a pair of snap hooks threadedly carried by said closed loop;

d) attaching one of said snap hooks to each of said left and right rings and applying a desired downward force to said closed loop via said hand lead line;

e) whereby the length of the flexible line between said snap hooks and hence the distance between said snap hooks decreases in correspondence to the amount of hand lead line applied force and said hand applied force produces a downward control pressure via said nose strap to the horse's muzzle to provide said reduced stress handling.

7. The method of claim 6 including the further steps of:

a) providing at least one flexible tubing member disposed surrounding said flexible line, the length of said at least one tubing member being less than one tenth the length of said fixed length of flexible line and the diameter of said at least one tubing member being slightly greater than the diameter of said flexible line;

b) positioning said at least one tubing member along the loop at a location between said pair of snap hooks, with the tubing material exhibiting a particular range of friction at its outer surface;

c) such that the distance between said snap hooks decreases a first amount corresponding to the hand lead line applied downward force in the absence of engagement with said at least one tubing member and decreases a second lesser amount when said snap hooks frictionally engage said at least one tubing member.

8. The method of claim 7 including the further step of providing a lead line assembly made up of a unitary length of flexible line having said closed loop formed by clamping together a first end of said unitary length at a predetermined fixed length along said unitary length and said hand lead line extending therefrom to a second end of said unitary length.

9. The method of claim 6 including the further step of providing said closed loop formed from a fixed length of flexible line such that as the loop deforms under said applied downward force the circumferential extent of said loop remains constant.

10. The method of claim 6 including the further step of making up said lead line assembly from a unitary length of flexible line having said closed loop formed by clamping together a first end of said unitary length at a predetermined fixed length along said unitary length.

* * * * *